US007722096B2

(12) United States Patent
Arlinghaus et al.

(10) Patent No.: US 7,722,096 B2
(45) Date of Patent: May 25, 2010

(54) LATCHBOLT FOR A DOOR LOCK ASSEMBLY

(75) Inventors: Paul R. Arlinghaus, Fishers, IN (US); Bradley W. Trent, Noblesville, IN (US); Rick L. Brennaman, Monument, CO (US); James W. Overbey, Indianapolis, IN (US); Kenneth P. Cook, Indianapolis, IN (US); Russell A. Banks, Indianapolis, IN (US); Michael D. Coleman, Noblesville, IN (US)

(73) Assignee: Von Duprin, Inc., Indianapolis, IN (US)

( * ) Notice: Subject to any disclaimer, the term of this patent is extended or adjusted under 35 U.S.C. 154(b) by 0 days.

(21) Appl. No.: 11/398,334

(22) Filed: Apr. 5, 2006

(65) Prior Publication Data

US 2007/0246946 A1 Oct. 25, 2007

(51) Int. Cl.
*E05B 65/10* (2006.01)

(52) U.S. Cl. ..... 292/92; 292/93; 292/94; 70/92

(58) Field of Classification Search ..... 70/92–93; 292/92–94, 44
See application file for complete search history.

(56) References Cited

U.S. PATENT DOCUMENTS 1,535,210 A 4/1925 Dyer
2,762,642 A * 9/1956 Jewett ..... 292/92
2,893,772 A * 7/1959 Edwards ..... 292/223
3,614,145 A 10/1971 Zawadzki
3,970,339 A 7/1976 Haselton et al.
4,135,746 A 1/1979 Sterling
4,161,804 A 7/1979 D'Hooge et al.
4,314,722 A 2/1982 Logan, Jr.
4,324,425 A 4/1982 Logan
4,328,985 A 5/1982 Logan
4,351,552 A 9/1982 VanDerLinden
4,354,699 A 10/1982 Logan
4,466,643 A 8/1984 Godec et al.
4,470,625 A 9/1984 Walsh et al.
4,545,606 A * 10/1985 Vodra ..... 292/92

(Continued)

FOREIGN PATENT DOCUMENTS

EP 1 162 334 A1 12/2001

(Continued)

OTHER PUBLICATIONS

International Search Report and Written Opinion dated Mar. 4, 2007.

*Primary Examiner*—Peter M Cuomo
*Assistant Examiner*—Kristina R. Fulton
(74) *Attorney, Agent, or Firm*—Michael Best & Friedrich LLP

(57) ABSTRACT

A latchbolt configured for use with a door lock assembly. The door lock assembly is configured for interaction with a strike coupled to a door frame, and operable to place the latchbolt in a locked configuration using the strike to generally prevent rotation of the door and an unlocked configuration to allow rotation of the door. The latchbolt includes a first member and a second member movably coupled to the first member. When the latchbolt is in the locked configuration the second member is movable relative to the first member from a first position to a second position in response to a predetermined force applied to the door.

28 Claims, 8 Drawing Sheets

U.S. PATENT DOCUMENTS 4,656,690 A 4/1987 Katagiri et al.
4,680,891 A 7/1987 Perkins
4,709,950 A * 12/1987 Zortman ..... 292/92
4,715,146 A 12/1987 Atsumi et al.
4,741,563 A 5/1988 Cohrs
4,747,629 A 5/1988 Miller
4,785,286 A 11/1988 Martin
4,796,931 A 1/1989 Heid
4,801,163 A 1/1989 Miller
4,839,988 A 6/1989 Betts et al.
4,865,367 A 9/1989 Choi
4,875,722 A 10/1989 Miller et al.
4,927,193 A 5/1990 Miller
4,961,330 A 10/1990 Evans
4,968,070 A 11/1990 Choi
4,976,476 A 12/1990 Cross et al.
5,011,199 A 4/1991 Lowe et al.
5,016,927 A 5/1991 Toledo
5,169,185 A 12/1992 Slaybaugh et al.
5,184,852 A 2/1993 O'Brien
5,219,385 A * 6/1993 Yeh ..... 70/92
5,340,171 A 8/1994 Slaybuagh et al.
5,464,259 A * 11/1995 Cohrs et al. ..... 292/92
5,484,176 A 1/1996 Sallwasser
5,605,362 A 2/1997 Surko, Jr.
5,640,863 A 6/1997 Frolov
5,673,949 A 10/1997 Mader et al.
5,762,385 A 6/1998 Mader et al.
5,890,752 A * 4/1999 Lin ..... 292/92
5,904,384 A 5/1999 Mader et al.
5,927,765 A 7/1999 Austin et al.
5,947,534 A 9/1999 Zarzycki, Jr.
6,032,985 A 3/2000 Cutter
6,048,000 A 4/2000 Geringer et al.
6,145,897 A 11/2000 Locher
6,409,232 B1 6/2002 Nigro, Jr. et al.
6,532,777 B2 * 3/2003 Haeck et al. ..... 70/92
6,623,050 B1 9/2003 Peng
6,641,183 B2 11/2003 Brown
7,070,210 B2 * 7/2006 Lin ..... 292/93

FOREIGN PATENT DOCUMENTS

EP 1 355 028 A2 10/2003

* cited by examiner

LATCHBOLT FOR A DOOR LOCK ASSEMBLY

BACKGROUND

The present invention relates to door lock assemblies, and more particularly to latchbolts for door lock assemblies.

Door lock assemblies typically include a latchbolt movably coupled to a door. The latchbolt engages a strike coupled to a door frame to prevent the door from being opened when the latchbolt is in a locked and extended position. Exit doors found in large facilities or public buildings typically include a push-bar that can be depressed to unlock the latchbolt thereby allowing a user to open the door. When the door returns to the closed position, the latchbolt returns to the locked and extended position to prevent the door from being opened unless the push-bar is depressed.

SUMMARY

In one embodiment, the invention provides a latchbolt configured for use with a door lock assembly. The door lock assembly is configured for interaction with a strike that is coupled to a door frame, and is operable to place the latchbolt in a locked configuration using the strike to generally prevent rotation of the door and an unlocked configuration to allow rotation of the door. The latchbolt includes a first member and a second member movably coupled to the first member. When the latchbolt is in the locked configuration the second member is movable relative to the first member from a first position to a second position in response to a predetermined force applied to the door.

In another embodiment the invention provides a door lock assembly configured for use with a door hingedly coupled to a door frame that includes a strike such that the door rotates about an axis between a closed position and an open position. The door lock assembly includes a latchbolt configured to engage the strike to substantially prevent rotation of the door from the closed position to the open position. An engagement point is defined as the point on the strike where the latchbolt contacts the strike when the door is in the closed position. An engagement angle is defined as the angle between a line that extends from the center of the strike through the engagement point and a plane that extends generally vertically and generally normal to the door frame. The latchbolt is configured to engage the strike in the closed position at one of a first engagement angle and a second engagement angle that is different from the first engagement angle.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The present invention will be described with reference to the accompanying drawing figures wherein like numbers represent like elements throughout. Certain terminology, for example, "upper", "lower", "right", "left", "clockwise", and "counterclockwise" is used in the following description for relative descriptive clarity only and is not intended to be limiting.

DETAILED DESCRIPTION

Figure 1:
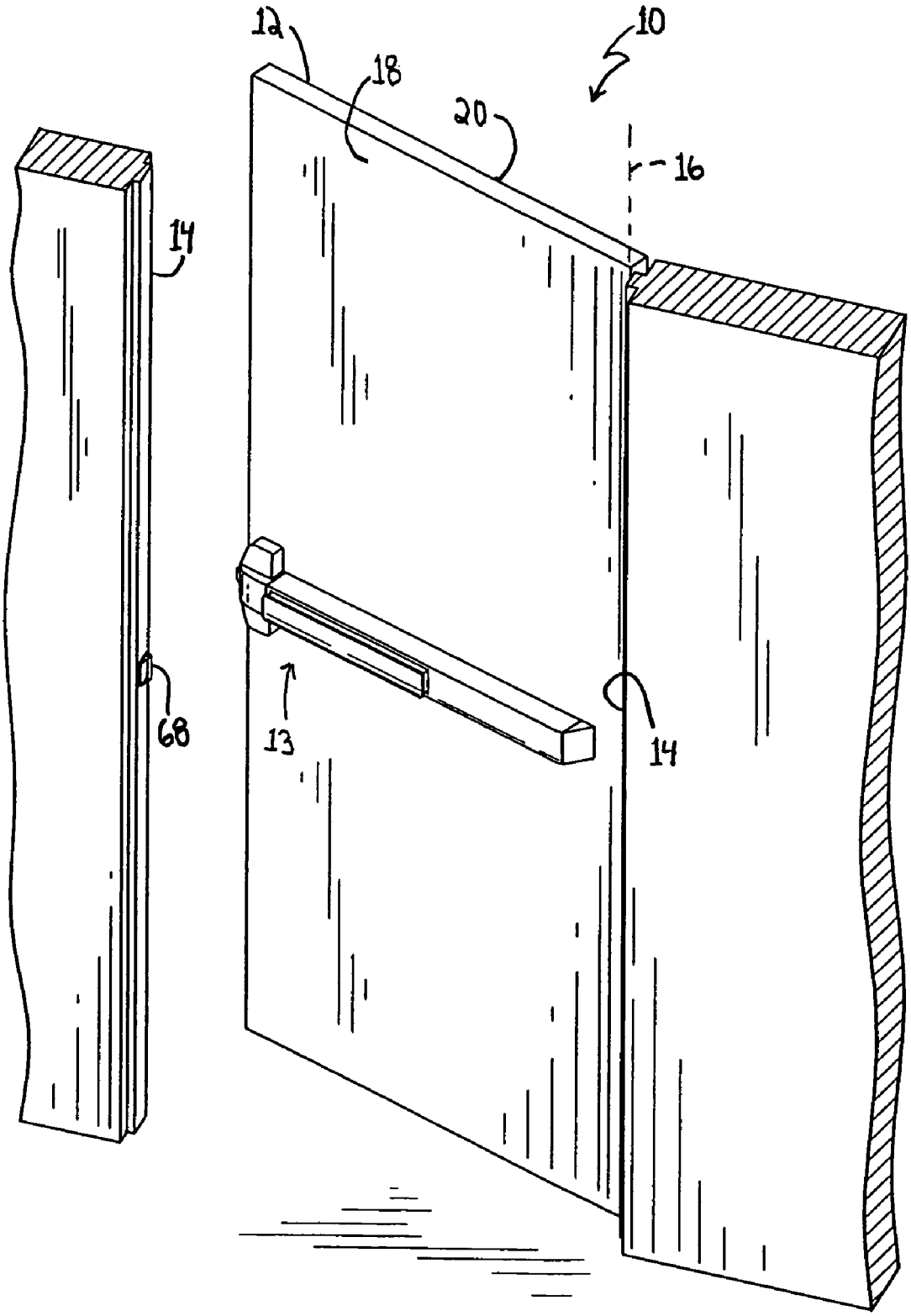
FIG. 1 is a perspective view of a door assembly in an open position that employs a latchbolt embodying the present invention.

FIG. 1 illustrates a door assembly 10 that includes a door 12 and a lock assembly 13 coupled to the door 12. The door 12 is hingedly coupled to a door frame 14 such that the door 12 can rotate about an axis 16 between a closed position and an open position. While the illustrated door assembly 10 is arranged such that the door 12 rotates or opens outwardly, in other constructions the door assembly can be arranged such that the door rotates or opens inwardly.

Figure 3:
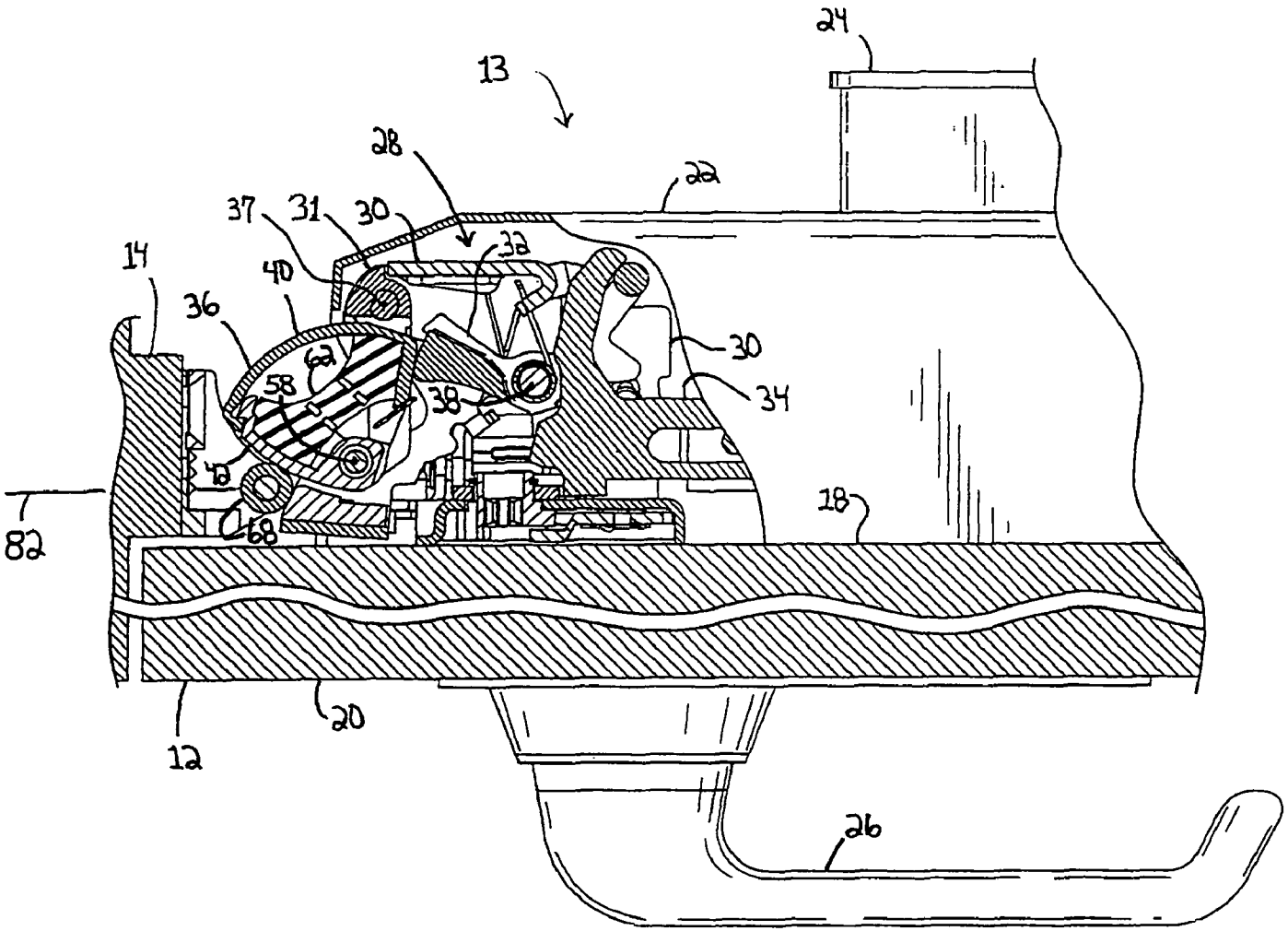
FIG. 3 is a partial cross-sectional view of a portion of the door assembly taken through lines 3-3 of FIG. 2 showing the latchbolt in a first position.

Referring to FIGS. 1 and 3, the door 12 includes an interior surface 18 and an exterior surface 20. The door 12 can be made from any suitable material, such as wood, aluminum, steel, composite, etc., or any combination thereof. Furthermore, while FIG. 1 illustrates a single door arrangement, one of skill in the art would realize that in other constructions the door assembly can include double and multiple door arrangements.

Referring to FIG. 3, the lock assembly 13 includes a cover 22, an interior actuator 24, an exterior actuator 26, and a locking mechanism 28 that is generally enclosed within the cover 22. The interior and exterior actuators 24, 26 are operable to actuate a locking mechanism 28. The illustrated interior actuator 24 is a push-bar, and in other constructions, the interior actuator can be any suitable actuator, such as a rotatable handle and the like. The illustrated exterior actuator 26 is a rotatable handle, and in other constructions the exterior actuator can be any suitable actuator. In yet other constructions, the lock assembly may omit the exterior actuator, and in such constructions the door assembly can include an exterior handle that is relatively fixed with respect to the door.

The illustrated locking mechanism 28 includes a housing 30, a bridge 31, a locking member 32, a control link 34, and a latchbolt 36. The housing 30 is coupled and fixed with respect to the door 12. The illustrated bridge 31 is rotatably coupled to the housing a pin such that the bridge 31 rotates with respect to the housing 30 about an axis 37. The locking member 32 is rotatably coupled to the housing 30 using a pin 38. The control link 34 is slidably coupled to the housing 30 and connected to the interior actuator 24 and the exterior actuator 26.

It should be understood that the locking mechanism can be any suitable locking mechanism such as the locking mechanism described in U.S. patent application Ser. No. 11/398, 574, filed Apr. 5, 2006, the entire contents of which are hereby incorporated by reference.

Figure 4:
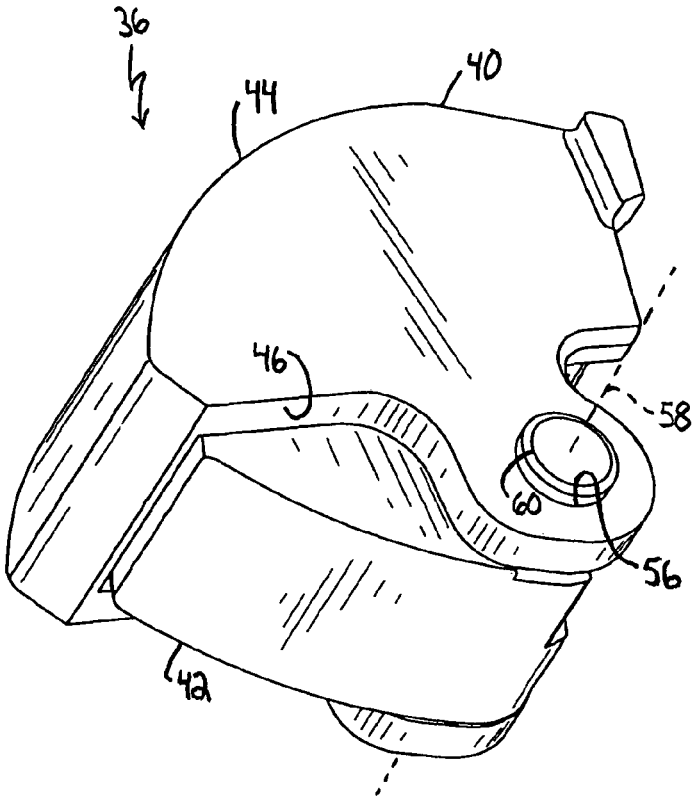
FIG. 4 is a perspective view of the latchbolt utilized by the door assembly of FIG. 1 showing the latchbolt in the first position.
Figure 5:
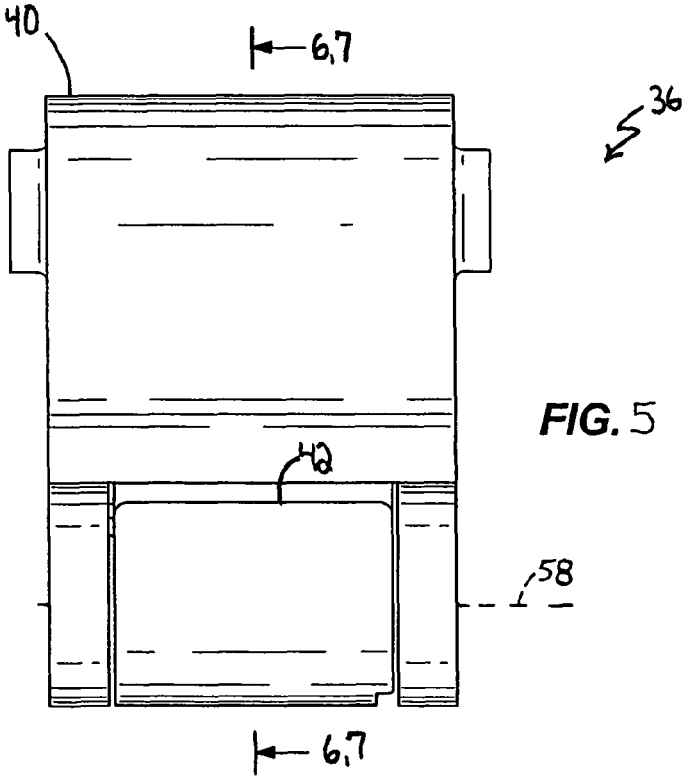
FIG. 5 is a side view of the latchbolt of FIG. 4 showing the latchbolt in the first position.
Figure 6:
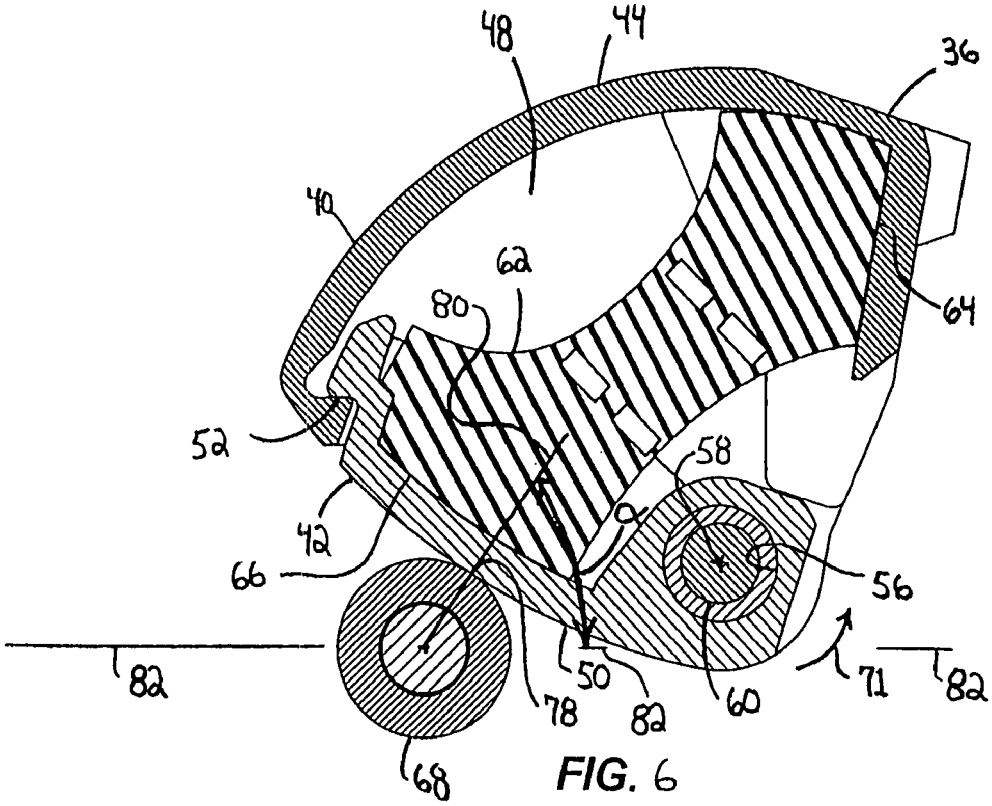
FIG. 6 is a cross-sectional view of the latchbolt taken along line 6-6 of FIG. 5 showing the latchbolt in the first position and a strike of the door assembly.

Referring to FIGS. 4-6, the latchbolt 36 includes a first member 40 and a second member 42 movably coupled to the first member 40. The illustrated first member 40 has a radiused or curved outer surface portion 44 and a generally flat outer surface portion 46. The illustrated first latchbolt member 40 is generally hollow and defines a cavity 48 that receives the second latchbolt member 42. The second latchbolt member 42 includes a curved outer surface 50 and a lip 52 formed at an end of the second member 42.

An aperture 56 extends through first and second latchbolt members 40, 42. The aperture 56 defines a latchbolt axis 58 that extends through the center of the aperture 56. The latchbolt aperture 56 receives a pin 60 that rotatably couples first and second latchbolt members 40, 42 and rotatably couples the latchbolt 36 to the bridge 31, which is rotatably coupled to the housing 30 of the locking mechanism 28 (FIG. 3). While the illustrated latchbolt 36 is coupled to the housing 30 using the bridge 31, in other constructions the latchbolt can be directly coupled to the housing, and the bridge can be omitted. In yet other constructions, the latchbolt can be coupled to any suitable member of the locking mechanism using any suitable connection.

Figure 8:
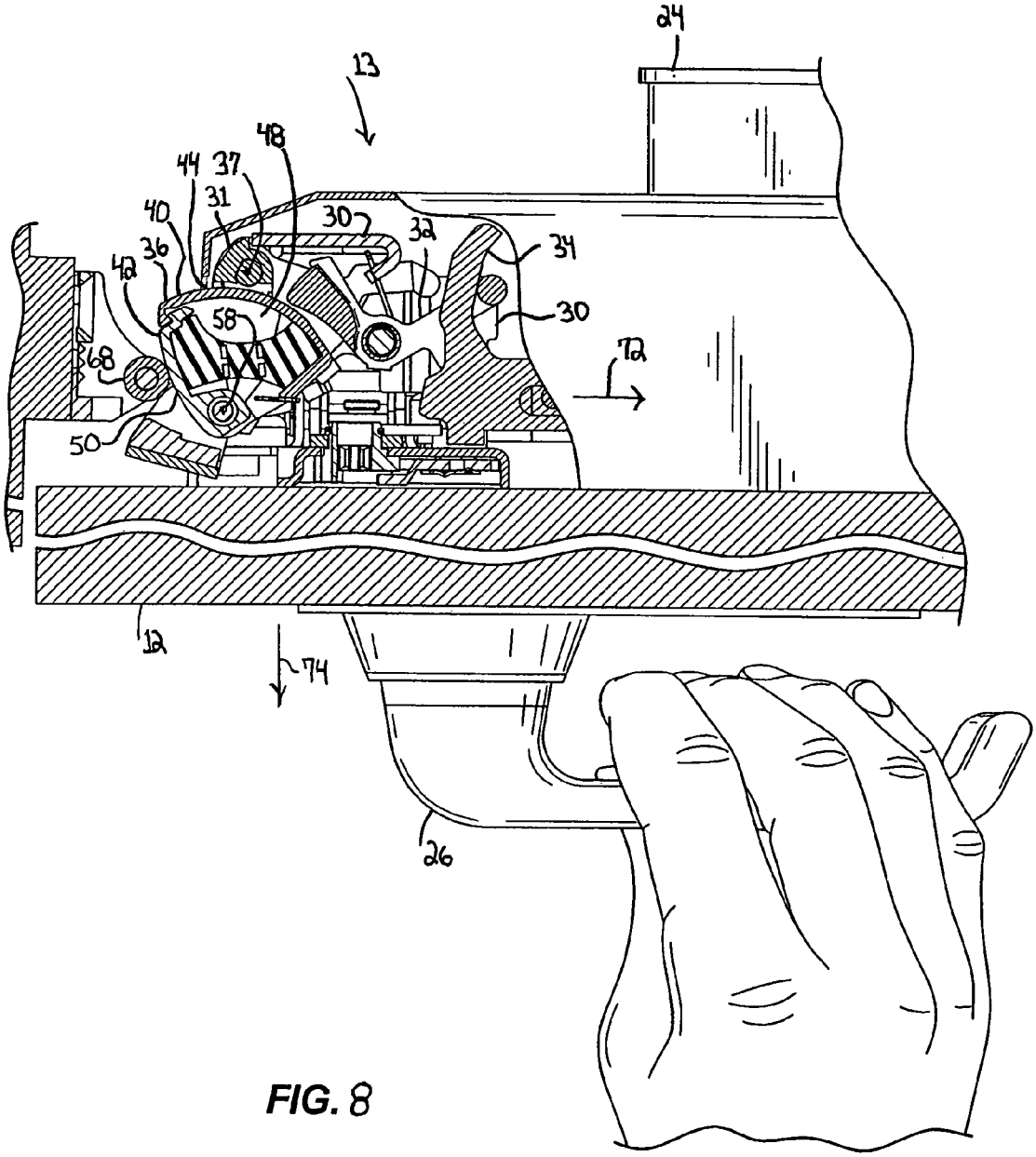
FIG. 8 is a partial cross-sectional view of a portion of the door assembly taken through lines 8-8 of FIG. 2 showing the door moving from the closed position to an open position.
Figure 9:
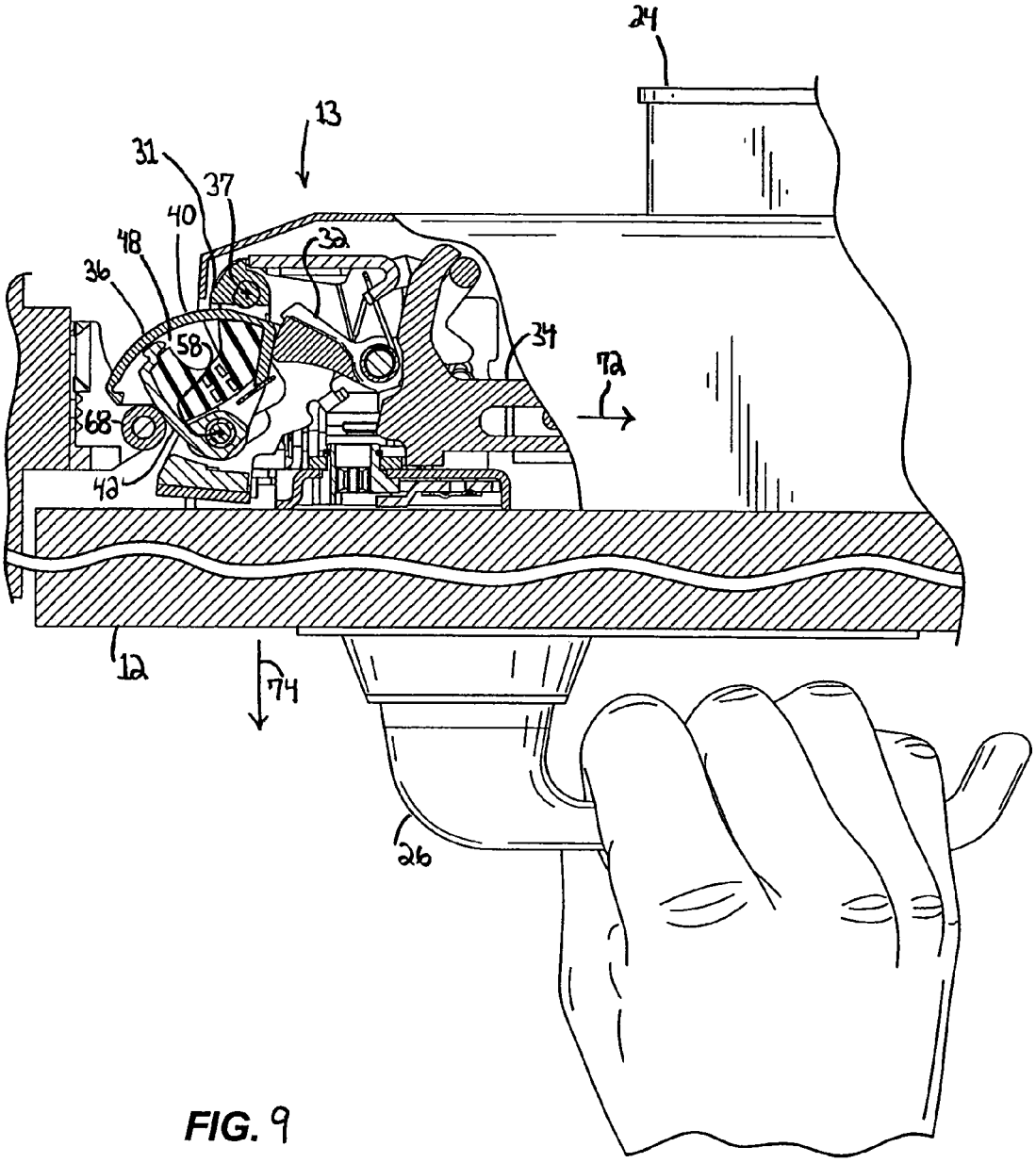
FIG. 9 is a partial cross-sectional view of a portion of the door assembly taken through lines 9-9 of FIG. 2 showing the door in the closed position and the latchbolt in the second position.
Figure 10A:
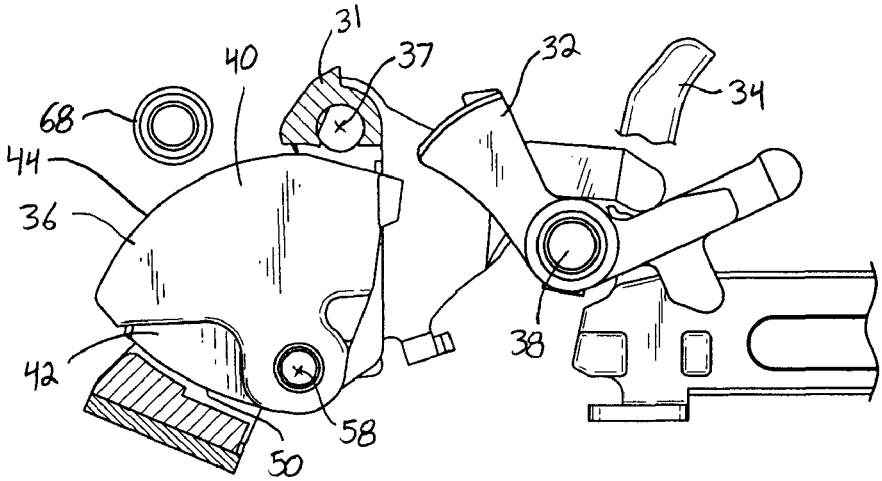
FIGS. 10*a*-10*c* illustrate a portion of the door assembly of FIG. 2 showing the latchbolt rotating about a bridge axis as the door moves from the open position to the closed position.
Figure 10B:
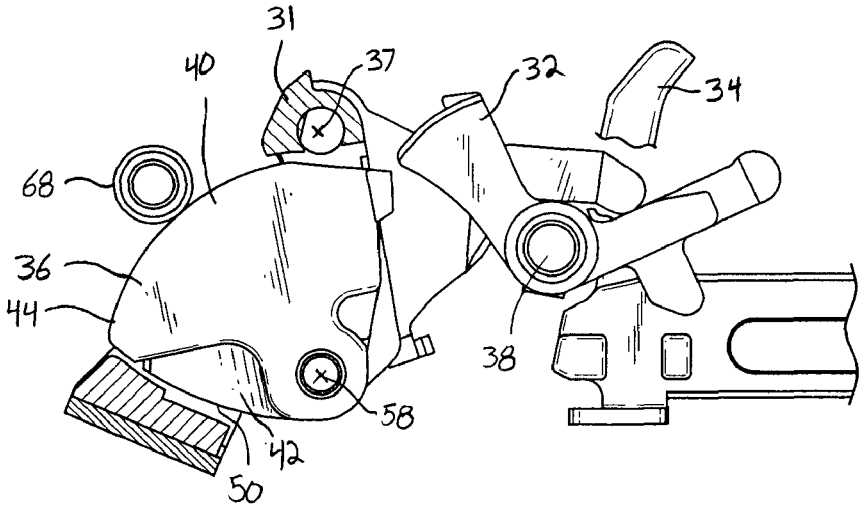
Figure 10C:
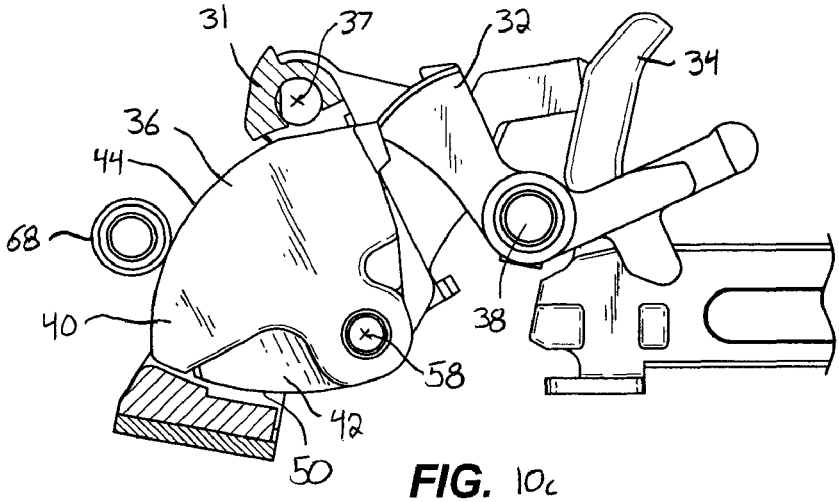

Referring to FIGS. 8 and 9, while the illustrated second latchbolt member 42 rotates with respect to the first latchbolt member 40 about the same axis 58 about which the latchbolt 36 rotates with respect to the bridge 31, in other constructions, the second latchbolt member 42 may rotate with respect to the first member 40 about an axis other than the axis 58 about which the latchbolt 36 rotates with respect to the bridge 31. In such constructions, the second latchbolt member 42 can rotate with respect to the first latchbolt member 40 about any suitable axis. In yet other constructions, the second latchbolt member 42 can be slidably coupled to the first latchbolt member 40 such that the second latchbolt member 42 slides into and out of the cavity 48 defined by the first latchbolt member 40.

Referring to FIG. 6, the latchbolt 36 further includes a biasing member 62 that includes a first end 64 and a second end 66. The biasing member 62 is located within the cavity 48 between the first and second latchbolt members 40, 42 such that the first end 64 contacts the first latchbolt member 40 and the second end 66 contacts the second latchbolt member 42. While the illustrated biasing member 62 is an elastomeric material such as butadiene rubber, in other constructions, the biasing member can be formed from any suitable material and may take other forms. For example, in other constructions the biasing member may include a spring, such as a coil spring, torsion spring, and the like.

Figure 2:
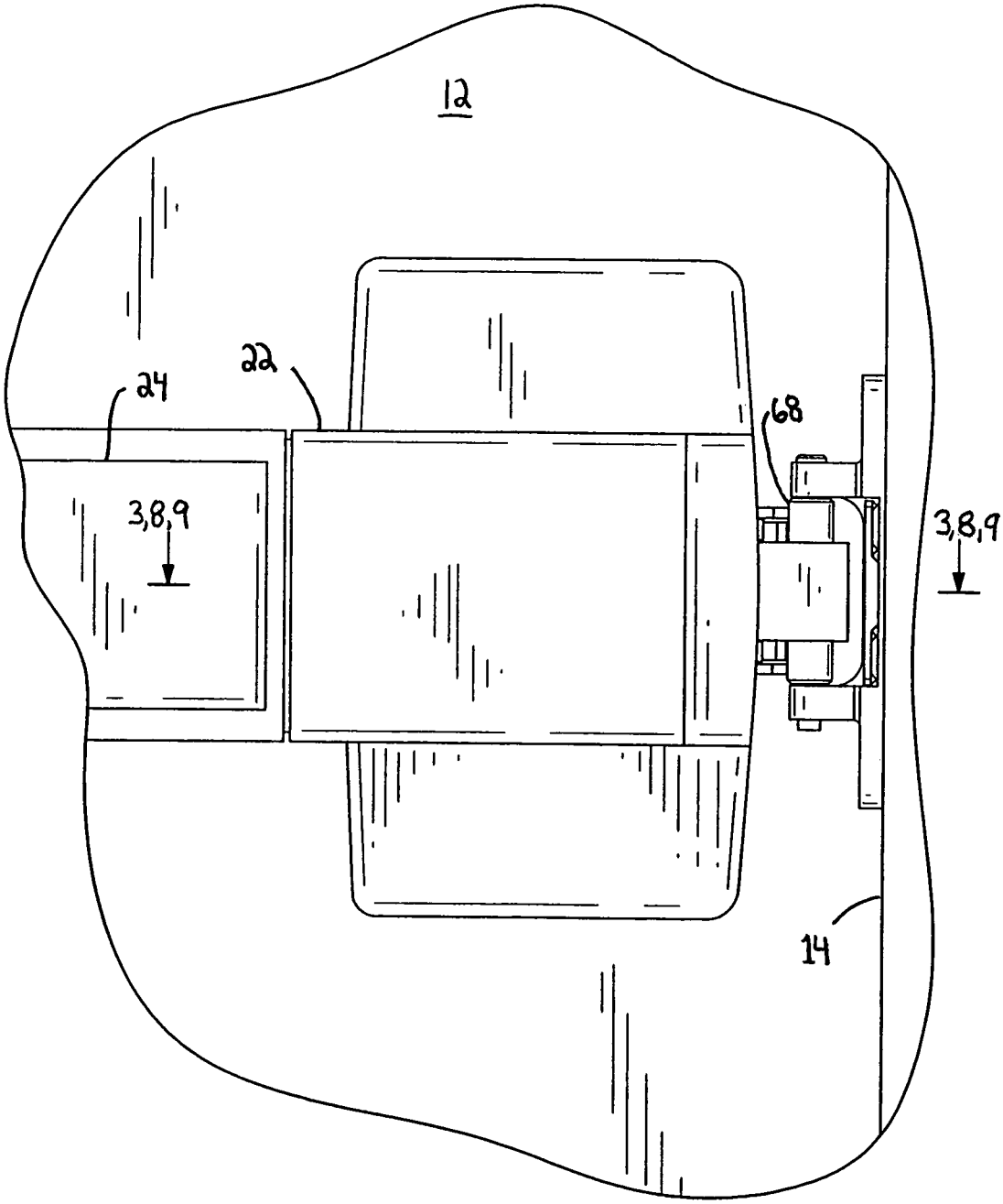
FIG. 2 is an enlarged side view of a portion of the door assembly of FIG. 1 showing the door in a closed position.

Referring to FIGS. 1 and 2, a strike 68 is coupled to the door frame 14, and in the illustrated construction the strike 68 is located on a vertical member of the door frame 14, opposite the axis 16. In other constructions, the strike 68 can be located at any suitable location on the door frame 14, such as along an upper or lower member of the door frame 14. Furthermore, while the illustrated door frame 14 includes one strike, in other constructions the door frame can include more than one strike.

Referring to FIGS. 3 and 6, in operation, the latchbolt biasing member 62 biases the second latchbolt member 42 in a direction out of the cavity 48 or in a direction about the latchbolt axis 58 indicated by the arrow 71 in FIG. 6. FIGS. 3 and 6 illustrate the second latchbolt member 42 in a fully extended or a first position such that the lip 52 of the second latchbolt member 42 abuts a corresponding portion of the first latchbolt member 40 that acts as a stop to prevent further rotation of the second latchbolt member 42 with respect to the first latchbolt member 40 in the direction indicated by the arrow 71.

Referring to FIGS. 3 and 6, when the door 12 is in the closed position the latchbolt 36 is in an extended position such that the curved surface 50 of the second latchbolt member 42 contacts the strike 68. Furthermore, the locking member 32 contacts the latchbolt 36 to lock the latchbolt 36 in the extended position (FIG. 3) when the door 12 is closed.

Referring to FIGS. 3 and 6, an engagement point 78 is defined as the point on the strike 68 that contacts the latchbolt 36. An engagement angle $\alpha$ is defined as the angle between a line 80 that extends from the center of the strike 68 through the engagement point 78 and a plane 82 that extends generally vertically and generally normal to the door frame 14. FIGS. 3 and 6 illustrate the second latchbolt member 42 in the fully extended, or first position and the engagement angle $\alpha$ is about 60 degrees. In other constructions, the engagement angle, with the second latchbolt member 42 in the first position, can be any suitable angle, such as engagement angles between about 30 degrees and about 80 degrees.

Referring to FIG. 3, in the illustrated construction, the lock assembly 13 can be placed in a locked or an unlocked configuration. If the lock assembly 13 is in the locked configuration a user is unable to actuate the locking mechanism 28 using the exterior actuator 26. However, the lock assembly 13 can be actuated using the interior actuator 24. The user can actuate the locking mechanism 28 using either the interior or exterior actuators 24, 26 if the lock assembly 13 is in the unlocked configuration.

Referring to FIG. 8, with the lock assembly 13 in the unlocked configuration, the user rotates the exterior actuator 26 to move the control link 34 in a direction indicated by an arrow 72. Likewise, the user could depress the interior actuator 24 to produce the same movement of the control link 34. Moving the control link 34 in the direction of the arrow 72 rotates the locking member 32 to disengage the locking member 32 from the latchbolt 36. The user then pulls the door 12 in a direction indicated by an arrow 74 to open the door 12. As the user opens the door 12, the latchbolt 36 rotates about the latchbolt axis 58 into a recessed position to allow the user to open the door 12.

In the illustrated construction, as the door 12 rotates from the open position to the closed position, the strike 68 engages the curved surface 44 of the first latchbolt member 40 and forces the latchbolt 36 and the bridge 31 to rotate about the axis 37, such that the latchbolt 36 rotates into the recessed position allowing the door 12 to rotate to the closed position. When the door 12 is in the closed position, the curved surface 50 of the second member 42 enables the latchbolt 36 to rotate about the axis 37 back into the extended position while maintaining contact with the strike 68.

Referring to FIG. 9, with the door 12 in the closed position and the lock assembly 13 in the locked configuration, the user is unable to move the control link 34 in the direction indicated by the arrow 72 by rotating the exterior actuator 26. Therefore, the locking member 32 remains engaged with the latchbolt 36 thereby locking or preventing the latchbolt from rotating about the latchbolt axes 58 or 37 preventing the door 12 from opening.

Figure 7:
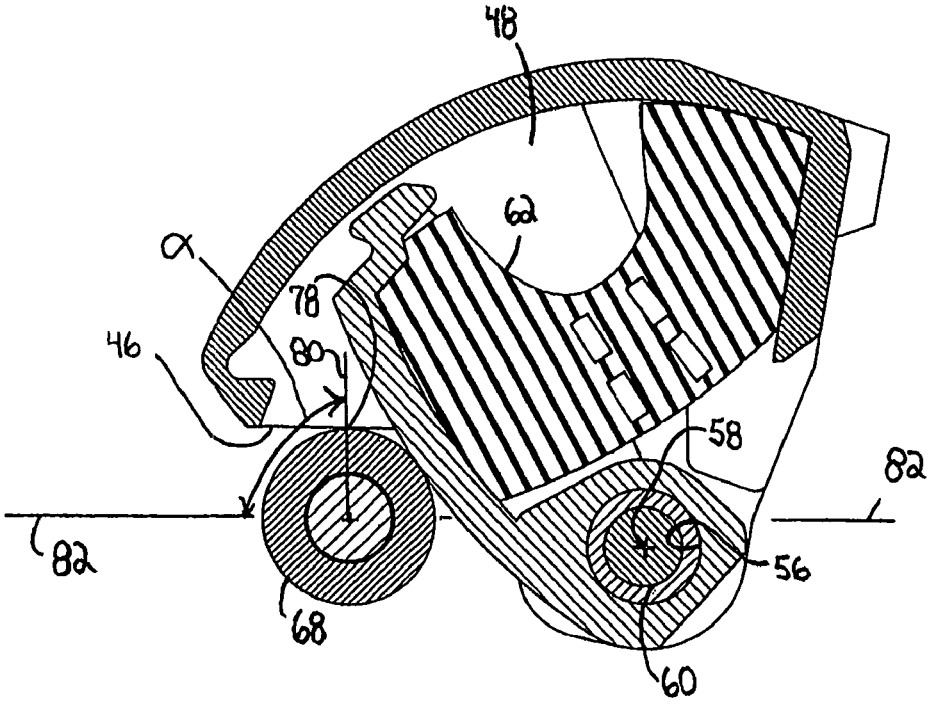
FIG. 7 is a cross-sectional view of the latchbolt taken along line 7-7 of FIG. 5 showing the latchbolt in a second position and the strike of the door assembly.

Referring to FIGS. 7 and 9, with the door 12 in the closed position and the lock assembly 13 in the locked configuration, when a force is applied to the door 12 in a direction that tends to rotate the door 12 toward the open position, the second latchbolt member 42 rotates with respect with the first latchbolt member 40. One example of such a force is illustrated in FIG. 9 and includes an unauthorized user pulling the exterior actuator 26 in the direction indicated by the arrow 74. When the force applied to the door 12 is greater or equal to a predetermined force, the second latchbolt member 42 rotates into a second or retracted position.

FIG. 7 illustrates the second latchbolt member 42 in the retracted or second position. In the second position the strike 68 engages the generally flat portion 46 of the first latchbolt member 40 to define an engagement angle $\alpha$ of about 90 degrees. While the illustrated latchbolt 36 is configured to have the engagement angle $\alpha$ of about 90 degrees when the second latchbolt member is in the second position, in other constructions, the engagement angle can be somewhat greater or less than 90 degrees. For example, in one construction, the engagement angle can be between about 80 degrees and about 110 degrees when the second latchbolt member is in the second position.

Engagement angles $\alpha$ that are about 90 degrees provide a more secure locking configuration than engagement angles that are less than about 90 degrees. When the engagement angle is less than 90 degrees the force applied to the door may spread or move the door frame members apart and thereby compromise the security provided by the door.

The predetermined force that moves the second member 42 from the first position (FIG. 6) to the second position (FIG. 7) can be any suitable force and can vary depending upon the application of the door lock assembly 13 and the type of door, door frame, strike, etc. Therefore, the biasing member 62 can be selected with a desired stiffness to determine the predetermined force that moves the second latchbolt member 42 from the first position (FIG. 6) to the second position (FIG. 7).

Various features and advantages of the invention are set forth in the following claims.

What is claimed is:

1. A door lock assembly for use with a door configured to rotate between a closed position and an open position, the door lock assembly configured for interaction with a strike coupled to a door frame, the door lock assembly comprising:

a latchbolt including a first member configured to engage the strike and configured to rotate with respect to the door about a first axis when the latchbolt is in an unlocked configuration, and a second member configured to engage the strike and movably coupled to the first member; and a locking mechanism operable to place the latchbolt in a locked configuration relative to the strike to generally prevent rotation of the door and the unlocked configuration to allow rotation of the door, wherein the second member moves relative to the first member from a first position, in which the second member directly engages the strike preventing the rotation of the door, to a second position, in which the first member and second member directly engage the strike preventing the rotation of the door, in response to a force applied in an opening direction to the door when the latchbolt is in the locked configuration and the door is in the closed position, and wherein the second member is coupled to the first member such that rotation of the first member about the first axis causes rotation of the second member.

2. The door lock assembly of claim 1, wherein the first member at least partially defines a cavity, and wherein the second member is at least partially received by the cavity when the second member is in the second position.

3. The door lock assembly of claim 2, wherein the latchbolt further includes a biasing member located at least partially within the cavity and configured to bias the second member into the first position.

4. The door lock assembly of claim 3, wherein the biasing member has a stiffness that defines the force.

5. The door lock assembly of claim 3, wherein the biasing member is an elastomeric material.

6. The door lock assembly of claim 5, wherein the elastomeric material is butadiene rubber.

7. The door lock assembly of claim 1, wherein the second member rotates between the first and second positions about the first axis.

8. The door lock assembly of claim 1, further comprising a bridge configured to couple to the door for rotation relative to the door about a second axis, wherein the latchbolt is supported by the bridge for rotation with the bridge about the second axis and is rotatable relative to the bridge about the first axis, and wherein the first member rotates about one of the first and second axes when the door rotates from the closed position to the open position and the second member rotates about the one of the first and second axes when the second member rotates between the first and second positions.

9. The door lock assembly of claim 1, wherein the second member includes a curved surface configured to engage the strike when the second member is in the first and second positions, wherein the first member includes a generally flat surface, and wherein when the second member is in the second position the generally flat surface of the first member is configured to engage the strike.

10. A door lock assembly for use with a door configured to rotate between a closed position and an open position, the door lock assembly comprising:

a housing configured to couple to the door such that the housing is substantially fixed with respect to door;

a bridge rotatably coupled to the housing about a first axis;

a latchbolt coupled to the bridge and configured to engage a strike, the latchbolt including, a first member configured to engage the strike and rotate with respect to the bridge about a second axis, and a second member configured to engage the strike and rotate with respect to the bridge and the first member about the second axis; and a locking mechanism coupled to the housing, the locking mechanism operable to place the latchbolt in a locked configuration relative to the strike to generally prevent rotation of the door and an unlocked configuration to allow rotation of the door, and wherein when the latchbolt is in the locked configuration and the door is in the closed position, the second member moves relative to the first member from a first position, in which the second member directly engages the strike preventing rotation of the door, to a second position, in which the first member and second member directly engage the strike preventing rotation of the door, in response to a force applied in an opening direction to the door, and wherein the second member is coupled to the first member such that rotation of the first member about the second axis causes rotation of the second member about the second axis.

11. The door lock assembly of claim 10, wherein the second member is rotatably coupled to the first member.

12. The door lock assembly of claim 10, wherein the latchbolt further includes a biasing member disposed between the first and second members, and wherein the biasing member has a stiffness that defines the force.

13. The door lock assembly of claim 10, wherein the locking mechanism includes a push-bar operable to place the latchbolt in the unlocked configuration from the locked configuration.

14. A door lock assembly for use with a door hingedly coupled to a door frame including a strike such that the door rotates about an axis between a closed position and an open position, the door lock assembly comprising:

a housing configured to couple to the door such that the housing is substantially fixed with respect to door;

a latchbolt configured to engage the strike to substantially prevent rotation of the door from the closed position to the open position, the latchbolt including, a first member configured to engage the strike and rotate with respect to the housing about a first axis when the door moves from the open position toward the closed position, a second member configured to engage the strike and movably coupled to the first member such that the second member moves relative to the first member from a first position to a second position in response to a force applied in an opening direction to the door, wherein an engagement point is defined as the point on the strike where the latchbolt contacts the strike when the door is in the closed position;

wherein an engagement angle is defined as the angle between a line that extends from the center of the strike through the engagement point and a plane that extends generally vertically and generally to normal to the door frame; and wherein the latchbolt is configured to engage the strike when the door is in the closed position at a first engagement angle when the second member is in the first position and a second engagement angle when the second member is in the second position that is different from the first engagement angle while the first member is generally prevented from movement with respect to the housing.

15. The door lock assembly of claim 14, wherein the second engagement angle is between about 80 degrees and about 110 degrees.

16. The door lock assembly of claim 15, wherein the second engagement angle is about 90 degrees.

17. The door lock assembly of claim 14, wherein the first engagement angle is between about 30 degrees and about 80 degrees.

18. The door lock assembly of claim 14, wherein the latchbolt engages the strike at the second engagement angle in response to a force applied to the door in the closed position.

19. The door lock assembly of claim 18, wherein the first member at least partially defines a cavity, and wherein the second member is at least partially received by the cavity when the second member is in the second position, and wherein the latchbolt includes a biasing member located at least partially within the cavity and configured to bias the second member into the first position.

20. A door lock assembly for use with a door hingedly coupled to a door frame including a strike such that the door rotates about an axis between a closed position and an open position, the door lock assembly comprising:

a latchbolt that engages the strike to retain the door in the closed position, the latchbolt including, a first member configured to engage the strike as the door moves toward the closed position to cause the latchbolt to move in a first direction and after the door closes the latchbolt moves in a second direction, a second member movably coupled to the first member where both members are configured to directly engage the strike when the door is in the closed position preventing rotation of the door, an exterior handle manually operable to rotate the door toward the open position when the lock assembly is in an unlocked configuration and inoperable to rotate the door toward the open position when the lock assembly is in a locked configuration, wherein when a force is applied to the exterior handle in a direction to rotate the door toward the open position when the door lock assembly is in the locked configuration, the force causes the second member to move with respect to the first member until the first member directly engages the strike preventing rotation of the door.

21. The door lock assembly of claim 20, wherein the first member at least partially defines a cavity, wherein a portion of the second member is received within the cavity, and wherein the latchbolt includes a biasing member located at least partially within the cavity and configured to bias the second member with respect to the first member.

22. The door lock assembly of claim 20, wherein the second member is coupled to the first member for rotation with respect to the first member, and wherein the second member is coupled to the first member for co-rotation with the first member with respect to the door.

23. The door lock assembly of claim 20, wherein the latchbolt is movable between an extended position and a retracted position, wherein the latchbolt includes a first surface that engages the strike at a first angle when the latchbolt is in the extended position and the door is in the closed position, engagement of the strike by the first surface when the latchbolt is in the locked configuration and in the extended position resisting movement of the door toward the open position, and engagement of the strike by the first surface when the latchbolt is in the locked configuration and in the extended position and when sufficient force is applied to the door causing the first surface to move so that a second surface of the latchbolt engages the strike at a second angle different from the first angle, engagement of the strike by the second surface resisting further movement of the door toward the open position.

24. The door lock assembly of claim 23 wherein the door defines a plane when the door is in the closed position, wherein the first angle is neither perpendicular to nor parallel to the plane, and wherein the second angle is substantially perpendicular to the plane.

25. A door lock assembly for use with a door coupled to a door frame such that the door moves between a closed position and an open position, the door lock assembly comprising:

a strike configured to be mounted on the door frame;

a housing configured to be mounted on the door;

a latchbolt supported by the housing for movement between an extended position and a retracted position; and an operator actuatable mechanism for locking the latchbolt in the extended position;

the latchbolt having a first surface that engages the strike at a first angle when the latchbolt is in the extended position and the door is in the closed position, engagement of the strike by the first surface when the latchbolt is locked in the extended position resisting movement of the door toward the open position, and engagement of the strike by the first surface when the latchbolt is locked in the extended position and when sufficient force is applied to the door causing the first surface to move so that a second surface of the latchbolt engages the strike at a second angle different from the first angle, direct engagement of the strike by the first and second surface resisting further movement of the door toward the open position.

26. The door lock assembly of claim 25, wherein the door defines a plane when the door is in the closed position, wherein the first angle is neither perpendicular to nor parallel to the plane, and wherein the second angle is substantially perpendicular to the plane.

27. A door lock assembly for use with a door hingedly coupled to a door frame and including a strike such that the door rotates about an axis between a closed position and an open position, the door lock assembly comprising:

an exterior handle;

a locking mechanism that includes a housing and a locking member movably coupled to the housing, the locking member moves between a locked configuration and an unlocked configuration;

an interior actuator manually operable to move the locking member with respect to the housing; and a latchbolt movable with respect to the housing between an extended position and a retracted position, the latchbolt configured to engage the strike to retain the door in the closed position when the locking member is in the locked configuration and the latchbolt is in the extended position and the latchbolt moves to the retracted position by the exterior handle when the locking member is in the unlocked configuration to allow a rotation of the door toward the open position, the latchbolt including, a first member including an outer surface configured to directly contact the strike as the door moves from the open position toward the closed position, a flat surface, and a cavity, a second member at least partially received within the cavity of the first member and coupled to the first member such that the first and second members generally move together when the latchbolt moves between the extended and retracted positions, the second member movably coupled to the first member such that the second member moves relative to the first member from a first position to a second position, the second member including a curved surface configured to directly contact the strike along with the first member when the door is in the closed position preventing rotation of the door, a biasing member located at least partially within the cavity of the first member and between the first member and the second member to bias the second member toward the second position, wherein when a force is applied to the exterior handle in a direction to rotate the door toward the open position when the locking member is in the locked configuration and the door is in the closed position, the force causes the second member to move with respect to the first member thereby causing the flat surface of the first member to directly engage the strike preventing rotation of the door.

28. The door lock assembly of claim 1, wherein the second member includes a lip that engages a portion of the first member when the second member is in the first position, and wherein the lip is spaced apart from the portion of the first member when the second member is in the second position.

* * * * *

UNITED STATES PATENT AND TRADEMARK OFFICE

CERTIFICATE OF CORRECTION

PATENT NO. : 7,722,096 B2
APPLICATION NO. : 11/398334
DATED : May 25, 2010
INVENTOR(S) : Arlinghaus et al.

It is certified that error appears in the above-identified patent and that said Letters Patent is hereby corrected as shown below:

On the Title Pg, Item (75) Inventors, line 3, "Rick L. Brennaman" should be --Rick L. Brannaman--

On the Title Pg, Item (56) References Cited (page 2), after "5,219,385 6/1993 Yeh" and before "5,340,171 8/1994 Slaybuagh et al." insert --5,311,168 5/1994 Pease, Jr. et al--

Signed and Sealed this
Eleventh Day of January, 2011

David J. Kappos

David J. Kappos
*Director of the United States Patent and Trademark Office*